US006749106B2

(12) United States Patent
Keefe, Jr. et al.

(10) Patent No.: US 6,749,106 B2
(45) Date of Patent: Jun. 15, 2004

(54) SINGLE PIECE WEDGE LOCK PIZZA BOX

(75) Inventors: Walter D. Keefe, Jr., Carol Stream, IL (US); Nicholas A. Philips, Sugar Grove, IL (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 10/183,193

(22) Filed: Jun. 25, 2002

(65) Prior Publication Data

US 2003/0015578 A1 Jan. 23, 2003

Related U.S. Application Data

(60) Provisional application No. 60/301,720, filed on Jun. 28, 2001.

(51) Int. Cl.[7] ..... B65D 5/00

(52) U.S. Cl. ..... 229/110; 229/906; 229/149; 229/163; 229/188

(58) Field of Search ..... 229/110, 109, 229/149, 163, 186, 188, 906

(56) References Cited

U.S. PATENT DOCUMENTS 4,765,534 A * 8/1988 Zion et al. ..... 229/109
4,984,734 A * 1/1991 Zion et al. ..... 229/109
5,000,374 A * 3/1991 Deiger ..... 229/109
5,368,225 A * 11/1994 Ritter ..... 229/110
5,381,949 A * 1/1995 Correll ..... 229/198.2
5,402,929 A * 4/1995 Ritter et al. ..... 229/110
5,452,845 A * 9/1995 Ritter ..... 229/110
5,553,771 A * 9/1996 Correll ..... 229/110
6,092,715 A * 7/2000 Correll ..... 229/110
6,206,277 B1 * 3/2001 Correll ..... 229/101
6,290,122 B1 * 9/2001 Correll ..... 229/104

* cited by examiner

*Primary Examiner*—Tri M. Mai

(57) ABSTRACT

In accordance with the aspects of the present invention, an improved container locking arrangement for a single piece blank and container is disclosed. The present invention includes a blank or a container including a bottom panel with first and second bottom sidewall panels, front and rear opposing wall panels, and first and second box corner locking constructions. Engagement of the corner locking constructions hingedly controls the relative position of the bottom sidewall panels. The corner locking constructions form first and second angled sidewall panels. Sidewall panel tabs disposed on an edge of the angled sidewall panels engage slots on the front wall panel to lock the first and second sidewall panels and the front wall panel in an assembled position. A top panel is hingedly configured to cover the bottom panel, thereby closing the container. First and second top panel flaps engage the first and second corner locking constructions to lock the top panel relative to the bottom panel.

19 Claims, 11 Drawing Sheets

SINGLE PIECE WEDGE LOCK PIZZA BOX

RELATED APPLICATIONS

This application claims priority to U.S. Provisional Application No. 60/301,720 filed Jun. 28, 2001, the benefit of which is hereby claimed under 35 U.S.C. 119(e).

FIELD OF THE INVENTION

The present invention relates to corrugated board containers, and more particularly to pizza style containers formed from a single piece blank.

BACKGROUND OF THE INVENTION

Pizza style boxes are currently available in a wide variety of shapes and sizes. Many of the boxes include a square bottom panel, upright sidewalls, and a single lid panel that folds over the entire container. The sidewalls are typically formed as "rollover" walls that require a person to fold a first panel around a second panel and then secure the second panel into place.

Current container designs have a number of drawbacks. One disadvantage concerns the time to set up boxes. Many pizza establishments will use hundreds of pizza boxes at a single location during the dinner and evening hours. The boxes are often completely or partially set up ahead of time for use during these rush periods. Setting up a conventional pizza style box, however, takes time and labor, costs that must be accounted for in the price of the pizza. In addition, there is the difficulty encountered in forming and using these boxes, and particularly those with rolled sidewalls. Forming a rolled sidewall box can take more than an acceptable amount of time and can also place an employee at risk for "Carpal Tunnel Syndrome" or similar disorder due to the wrist motion required to form the rolled walls. Similar drawbacks are found when pizza style boxes are used in other applications, such as holding coiled hose or wire.

Such pizza boxes also suffer from the tendency for the lid to fail to maintain a closed position. When a pizza box lid pops open, the pizza product inside can suffer heat loss, and, depending on the circumstances, the pizza may become inadvertently contaminated. In addition, the closure mechanisms used to engage the lid can interfere with the top of the pie, resulting in a gooey, unappetizing mess.

SUMMARY OF THE INVENTION

In accordance with the aspects of the present invention, an improved box corner locking construction for a single piece blank and container is disclosed. The present invention includes a blank or a container including a bottom panel with first and second bottom sidewall panels, front and rear opposing wall panels, and first and second box corner locking constructions. Engagement of the corner locking constructions hingedly controls the relative position of the bottom sidewall panels. The corner locking constructions form first and second angled sidewall panels, which engage the front wall panel to lock the first and second sidewall panels and the front wall panel in an assembled position. A top panel is hingedly configured to cover the bottom panel, thereby closing the container. First and second top panel flaps engage the first and second corner locking constructions to lock the top panel relative to the bottom panel and to further reinforce the front wall panel.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawing and FIGURES, wherein.

DETAILED DESCRIPTION OF THE PREFERRED EMBODIMENT

Figure 1:
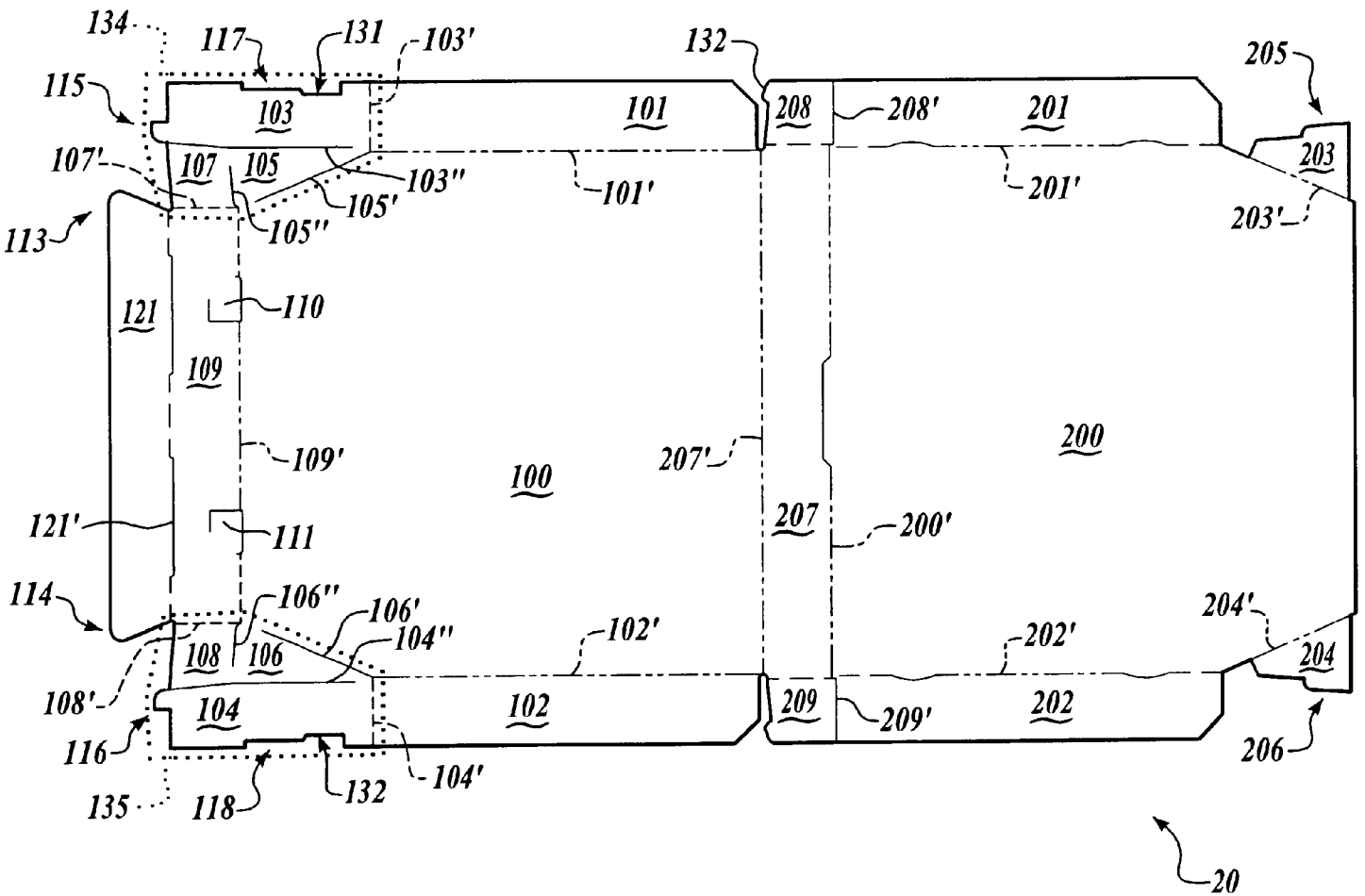
FIG. 1 is a plan view of a single-piece container blank formed in accordance with the present invention.
Figure 2:
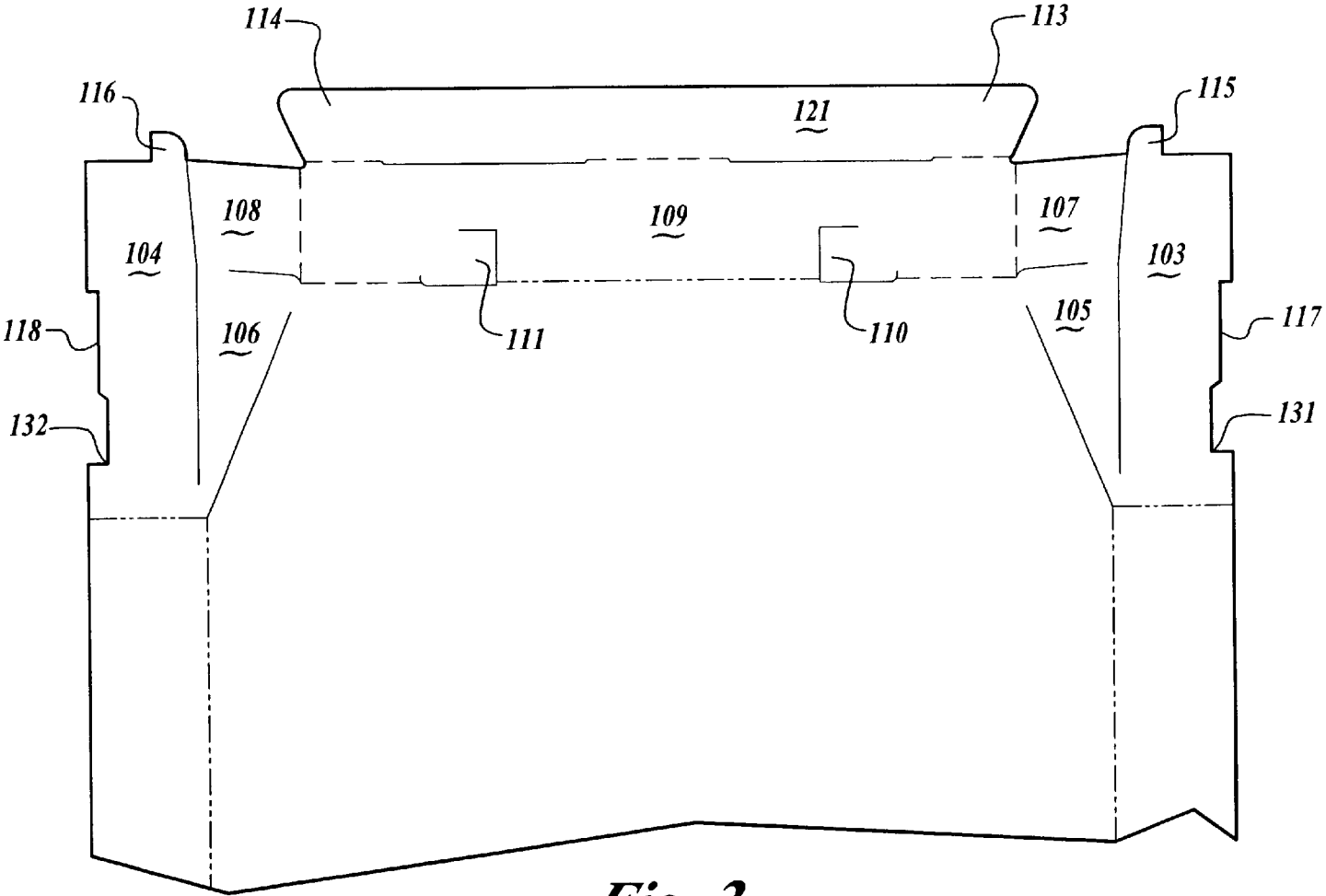
FIG. 2 is a partial plan view of the bottom panel illustrating the corner locking constructions of the present invention.

The present invention is an improvement to a pizza style corrugated board blank and container. By way of overview and with reference to FIGS. 1–10, one presently preferred embodiment of the present invention includes a single piece blank 20 of corrugated board material arranged to form a pizza style container 30. The blank 20 includes a bottom panel 100, rear wall panel 207 and a top panel 200.

The bottom panel 100 includes opposed first and second sidewalls 101 and 102, and opposed front and rear wall panels, 109 and 207. Additionally, the bottom panel 100 includes a first corner locking construction 134 and a second corner locking construction 135 arranged to control the assembly status of the respective walls of the bottom panel 100. The corner locking constructions 134, 135 include first and second angled sidewall panels 103, 104. Sidewall panel tabs 115, 116 disposed on an edge of the angled sidewall panels 103, 104 engage slots 110, 111 on the front wall panel to lock the first and second sidewall panels 101, 102 and the front wall panel 109 in an assembled position.

The top panel 200 includes opposed first and second sidewall panels 201 and 202, and first and second panel flaps 203 and 204. The first and second panel flaps 203, 204 interact with the respective first and second corner locking constructions 134, 135 and the front wall panel tabs 113, 114 to facilitate locking/unlocking of the container 30. Specific details of the blank 20 and the container 30 are described in more detail below.

The bottom panel 100 is generally rectangular in shape and tapers inwardly at a forward end. The periphery of the bottom panel 100 is configured to hingedly connect with various panels or walls. As will be appreciated, hinges, edges or fold lines may be formed by any means commonly known in the art, such as, without limitation, scoring, perforating or crimping.

First and second sidewall panels 101, 102 are generally rectangular in shape. The first and second sidewall panels 101,102 are hingedly connected to opposing side edges of bottom panel 100 along hinge lines 101' and 102', respectively. The outer rear corners of sidewall panels 101 and 102 are preferably beveled. Unclipped or unrounded sidewall panels are within the scope of the present invention.

FIGS. 1, 2 and 4–10, Front wall panel 109 shown in FIGS. 1, 2 and 4–10 is generally rectangular in shape. The front wall panel 109 is hingedly connected to an edge of bottom panel 100 along hinge line 109' and is hingedly connected on the edge opposing bottom panel 100 to front wall panel flap 121 along hinge line 121'. Front wall panel 109 includes upright slots 110, 111.

Front wall panel flap 121 is generally trapezoidal in shape and is hingedly connected only to the front wall panel 109. The edge opposite the edge hingedly connected to front wall panel 109 is greater in length than the edge hingedly connected to front wall panel 109. Front wall panel flap 121 includes first and second outer front wall panel tabs 113 and 114. The first and second front wall panel tabs 113, 114 are configured to interact with the first and second panel flaps 203, 204 (described below) to lock the container 30, the operation of which is described in more detail below.

The blank 20 further includes first and second corner locking constructions 134, 135. The first and second corner locking constructions 134, 135 include first and second angled sidewall panel bottoms 105 and 106, angled sidewall panels 103 and 104, and angled front panels 107 and 108. The various components of the first and second locking corners 131, 132 control the formation state of the first and second bottom sidewalls 101, 102 and the front wall 109 relative to the bottom panel 100.

The angled sidewall panel bottoms 105, 106 are generally triangular in shape. The angled sidewall panels 105, 106 are hingedly connected to opposing tapered side edges of the bottom panel along hinge lines 105' and 106', respectively. Angled sidewall panel bottoms 105 and 106 are further connected to angled front panels 107, 108 along hinge lines 105" and 106", respectively.

Angled sidewall panels 103 and 104 are hingedly connected to sidewall panels 101 and 102 along hinge lines 103' and 104' respectively, and hingedly connected to angled sidewall panel bottoms 105 and 106 along hinge lines 103" and 104" respectively. The angled sidewall panels 103, 104 are generally rectangular in shape. Angled sidewall panels 103 and 104 each includes sidewall tabs 115, 116, disposed on the end of angled sidewall panels 103 and 104 opposite the end hingedly connected to sidewall panels 101 and 102. Each sidewall tab 115, 116 is adapted to engage upright slots 110, 111 when the angled sidewall panels are folded upright and inwardly. Angled sidewall panels 103 and 104 further include notch regions 117 and 118 opposite hinge lines 103" and 104" respectively. Notch regions 117 and 118 include recesses 131 and 132, respectively.

Angled front panels 107 and 108 are hingedly connected to the remaining two opposing edges of the front wall panel 109 along hinge lines 107' and 108', respectively. Angled front panels 107 and 108 are not connected to angled sidewall panels 103 and 104.

Figure 3:
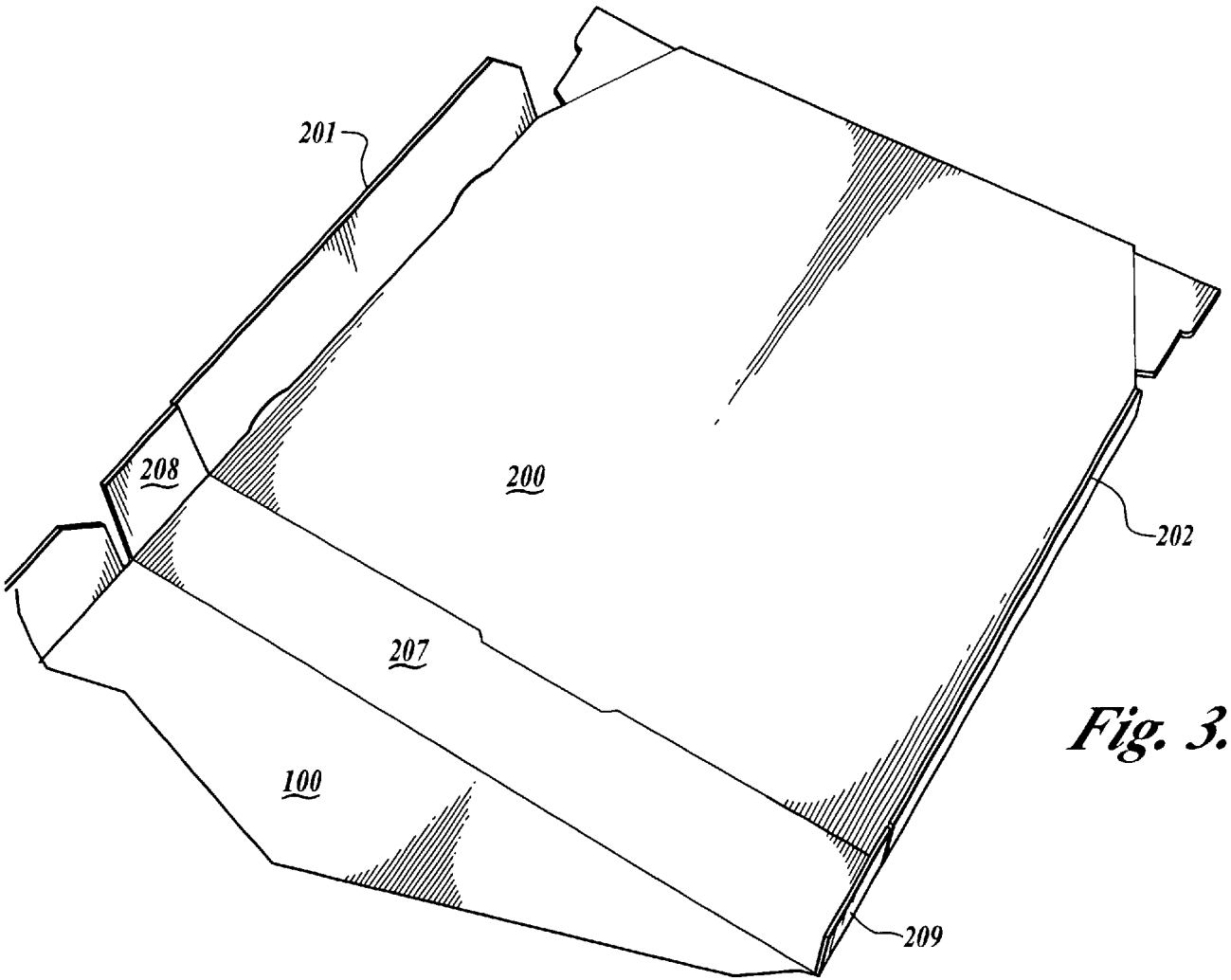
FIG. 3 is a perspective view of a partially assembled top panel assembly according to the present invention.
Figure 4:
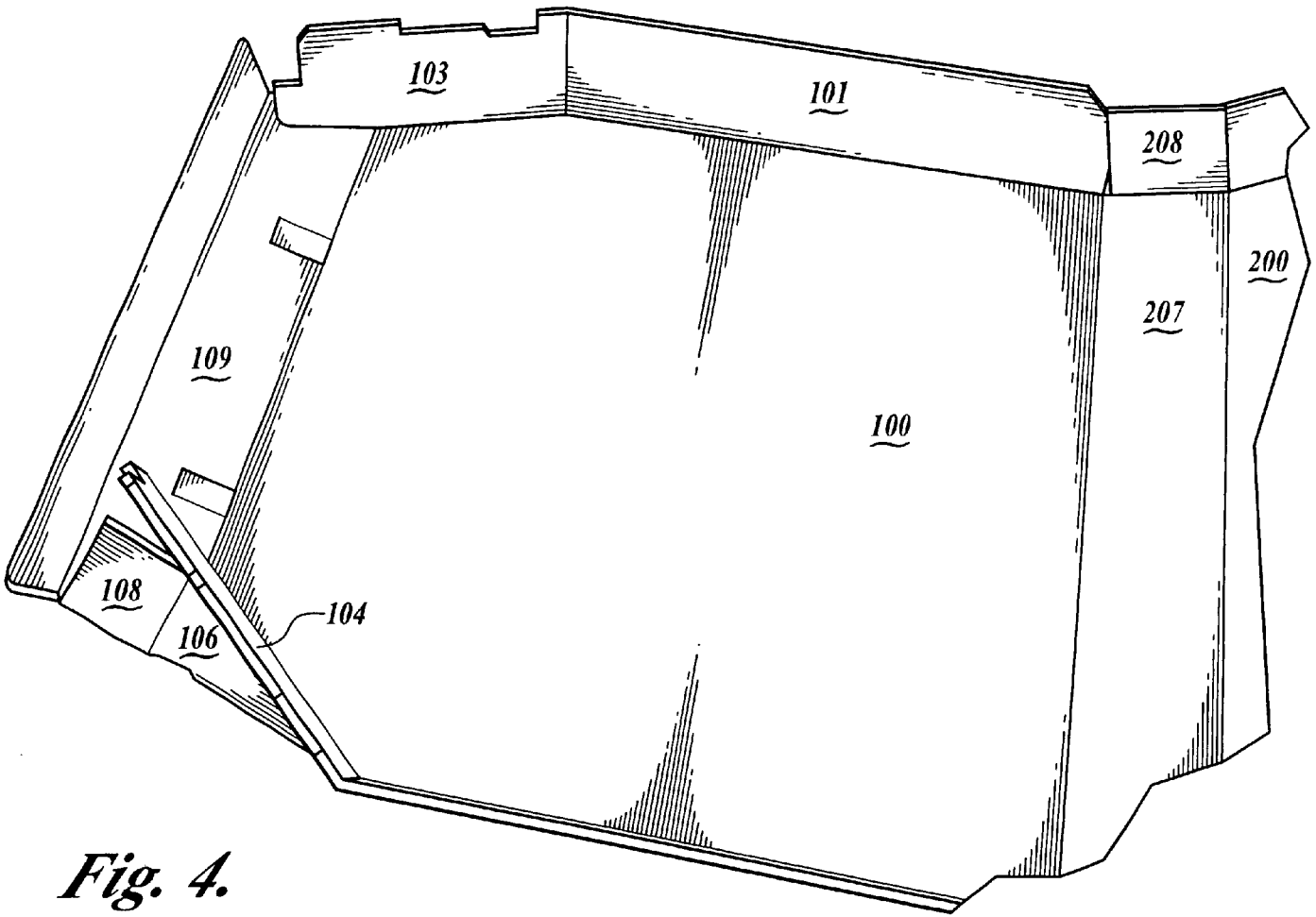
FIG. 4 is perspective view of a partially assembled corner locking construction according to the present invention.
Figure 5:
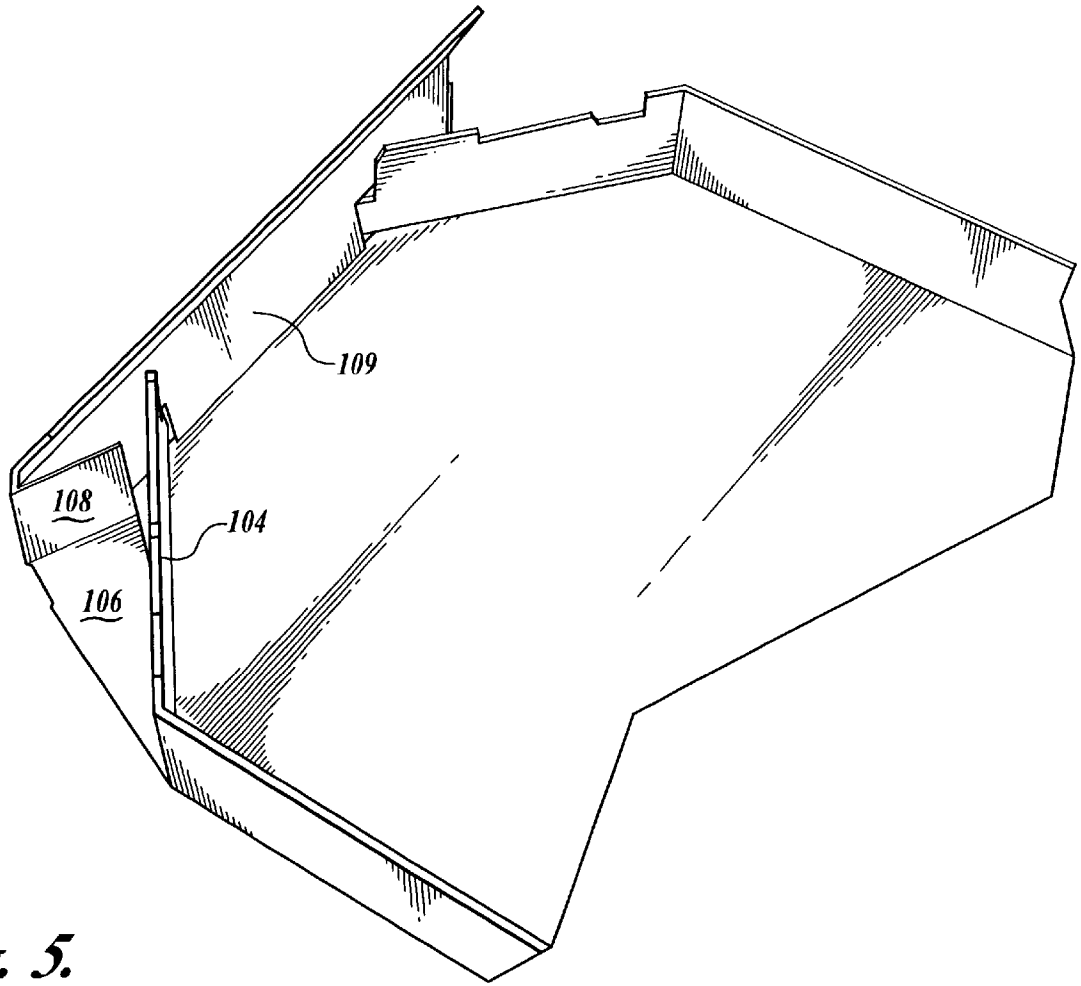
FIG. 5 is a perspective view of a more fully assembled corner locking construction according to the present invention.
Figure 6:
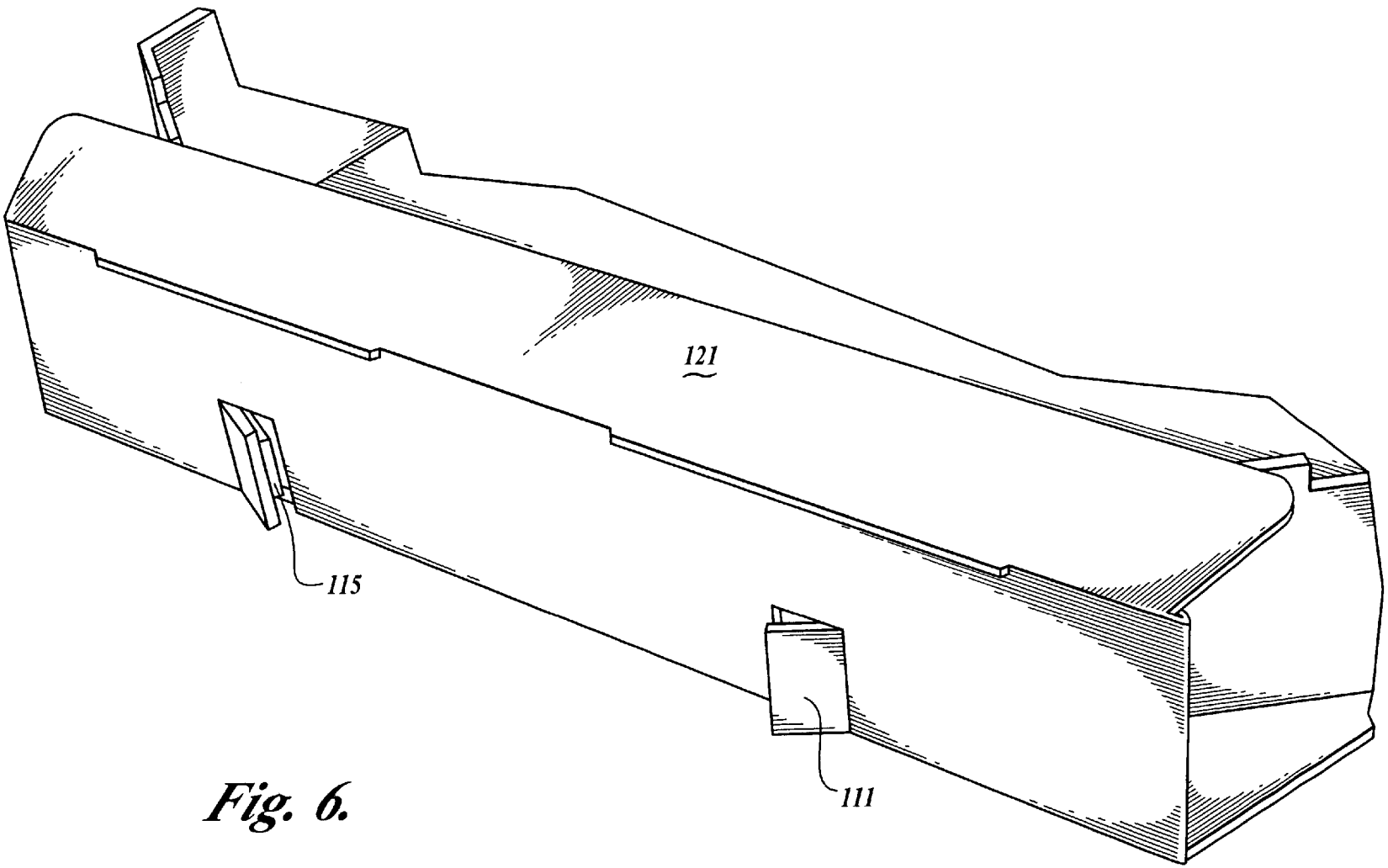
FIG. 6 is a perspective view of an aspect of the corner locking construction.
Figure 7:
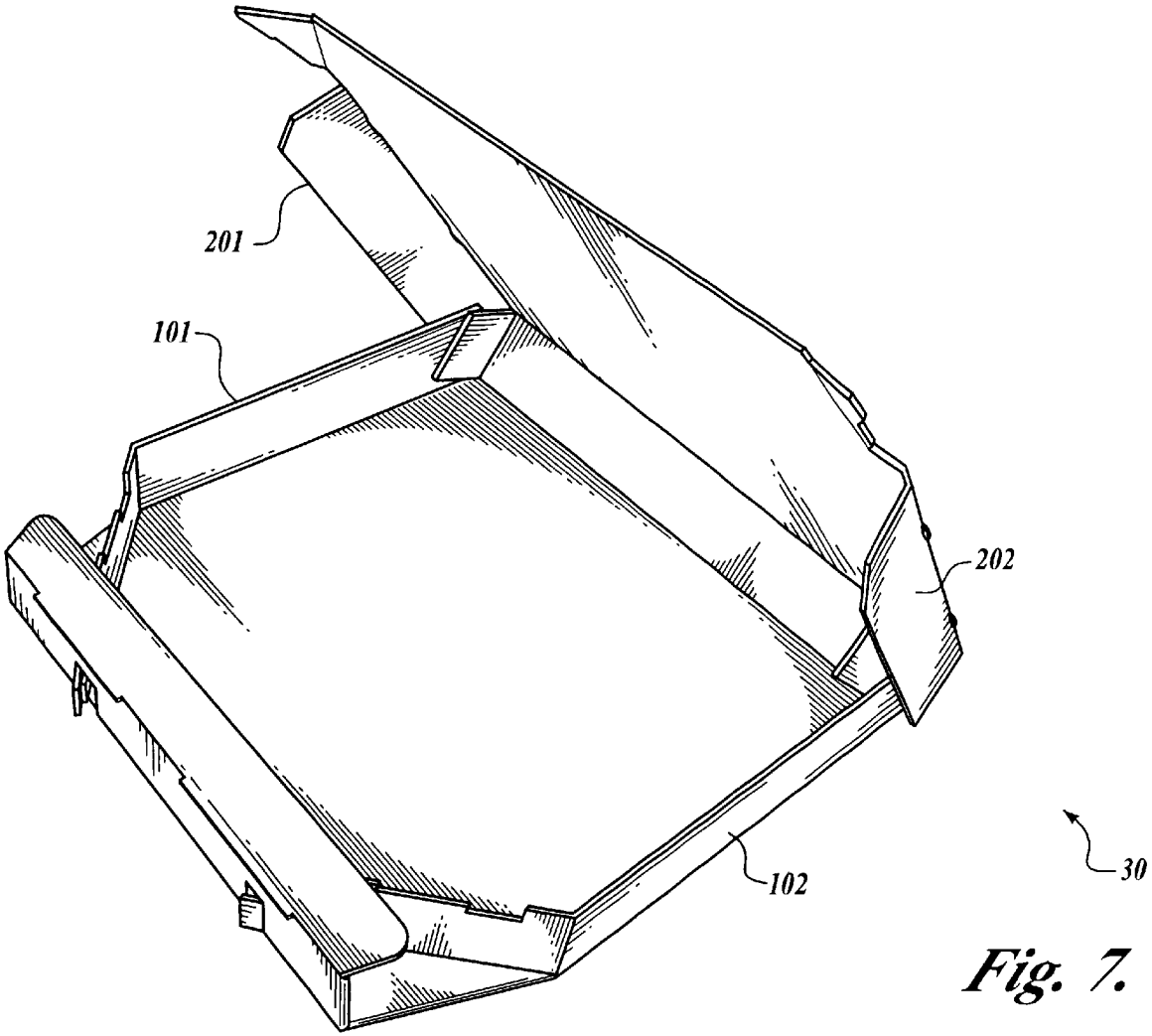
FIG. 7 is a perspective view of the partially assembled container of constructed from the blank depicted in FIG. 1.
Figure 8:
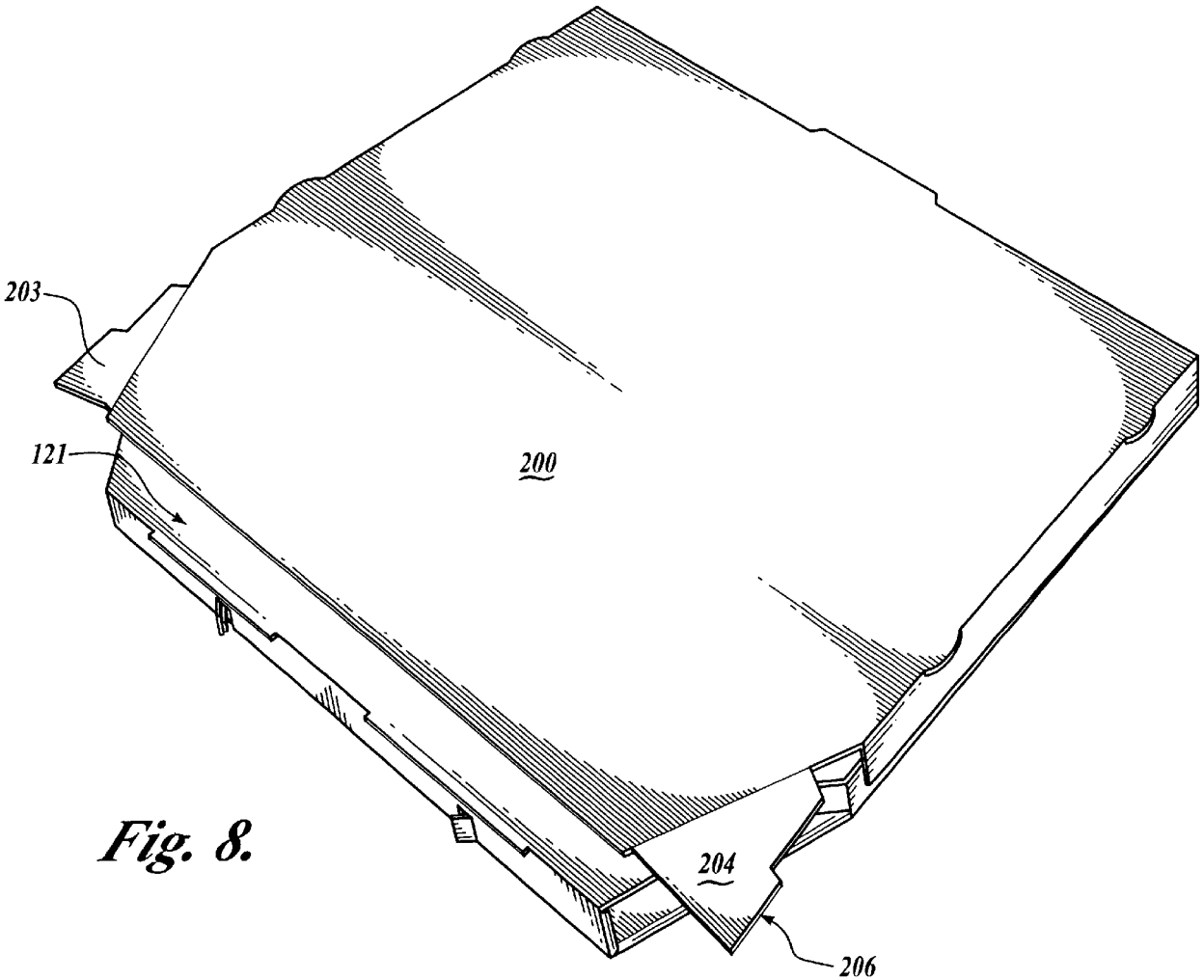
FIG. 8 is another perspective view of the assembled and closed container of the present invention before engaging the top panel flaps.
Figure 9:
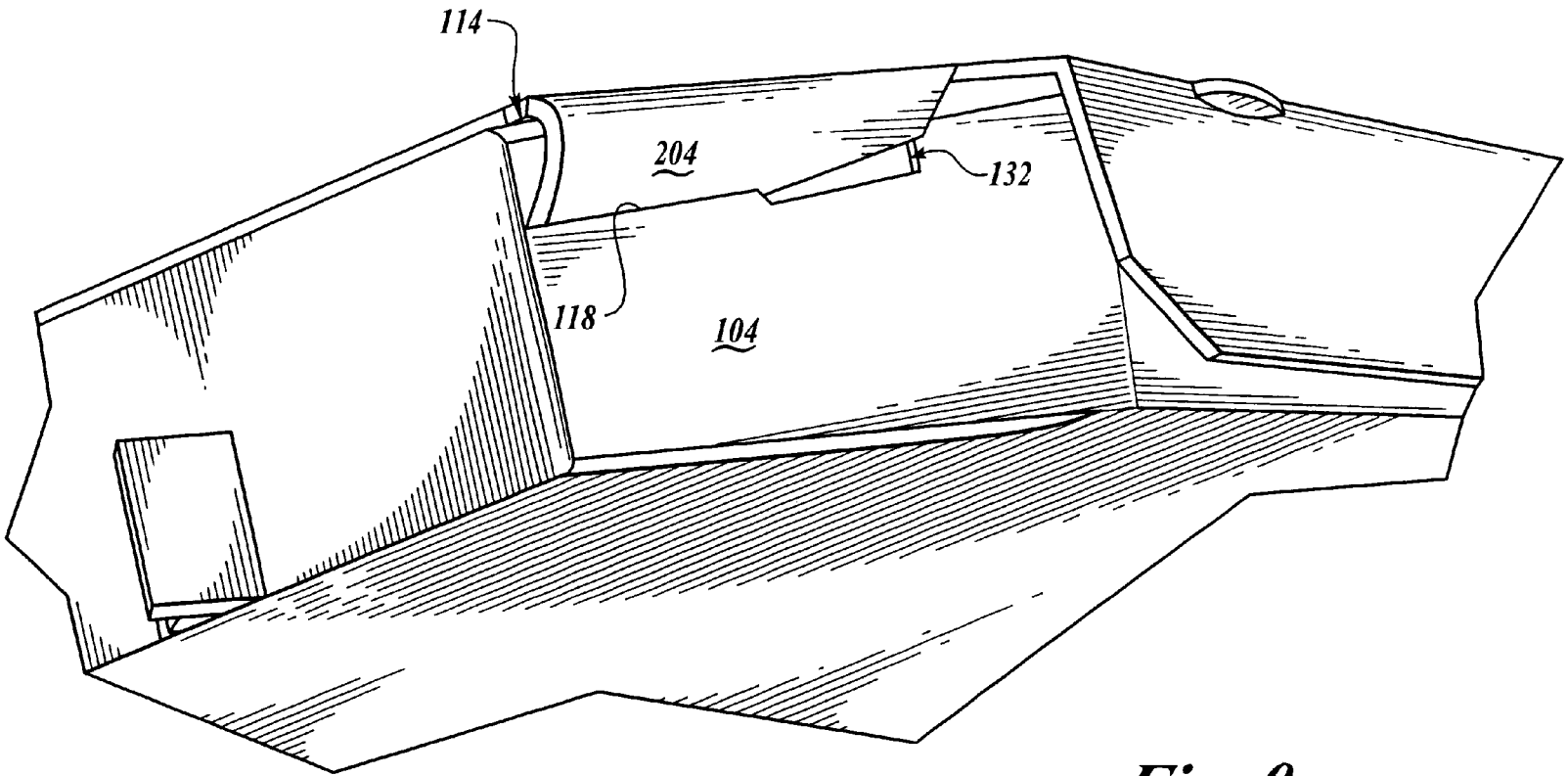
FIG. 9 is a partial perspective view of the corner locking construction final assembly.
Figure 10:
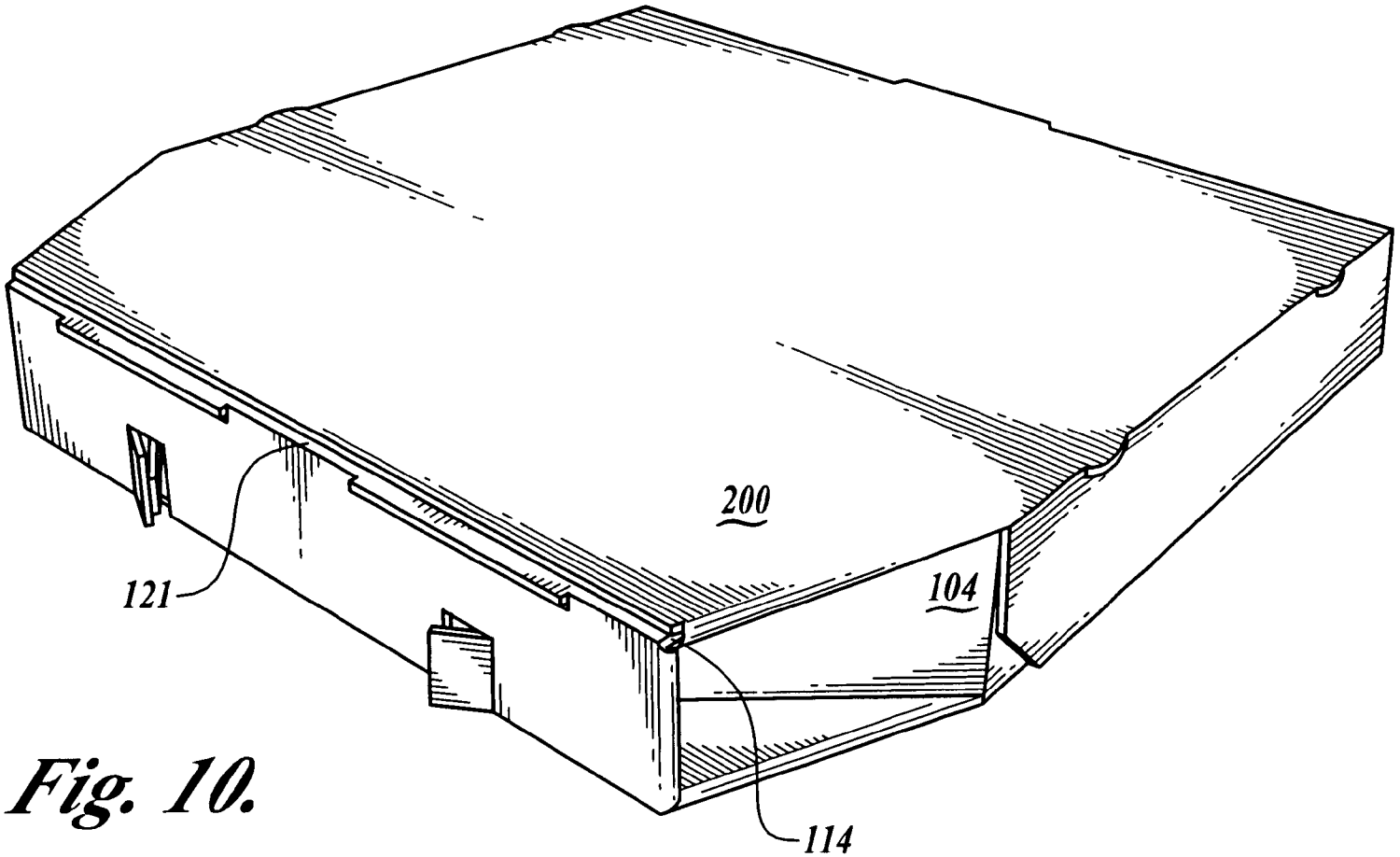
FIG. 10 is a perspective view of the closed and assembled container according to the present invention.

With reference to FIGS. 1 and 3, top panel 200 has a plurality of edges and has the same general shape, albeit slightly larger, as bottom panel 100. Top panel 200 is hingedly connected to top sidewall panels 201 and 202 along hinge lines 201' and 202', respectively. Additionally, the top panel is hingedly connected to a first and second top panel flap 203, 204 along hinge lines 203', 204', respectively Top sidewall panels 201 and 202 are generally rectangular in shape and are disposed on opposing sides of the top panel 200. The distance on the top panel 200 between top sidewall panel hinge lines 201' and 202' is slightly greater than the distance on bottom panel 100 between sidewall panel hinge lines 101' and 102'. Consequently, top sidewall panels 201 and 202 overlap and are outside of sidewall panels 101 and 102 when the container 30 has been assembled.

The first and second top panel flaps 203, 204 are generally triangular in shape. Top panel flaps 203 and 204 include top panel flap tabs 205 and 206 opposite hinge lines 203' and 204', respectively. The first and second top panel flaps 203, 204 are configured to cooperate with corner locking constructions 134, 135 during closing of the container 30 to form a fixed relationship between the bottom panel 100 and the top panel 200. More specifically, the first and second top panel flaps 203, 204 are hingedly arranged to frictionally fit between the notch regions 117, 118 and the front wall panel flap tabs 113 and 114, respectively (see FIG. 9).

The rear wall panel 207 is generally rectangular in shape and is hingedly connected to the bottom panel 100 and the top panel 200 along hinge lines 207' and 200', respectively. When the blank 20 is formed into the container 30 the rear wall panel 207 maintains a distance between the bottom panel 100 and the top panel 200, thereby helping to protect items placed within the container 30. The height of the rear wall panel 207 as well as the other side and front walls will depend on the product in the container 30.

Figure 11:
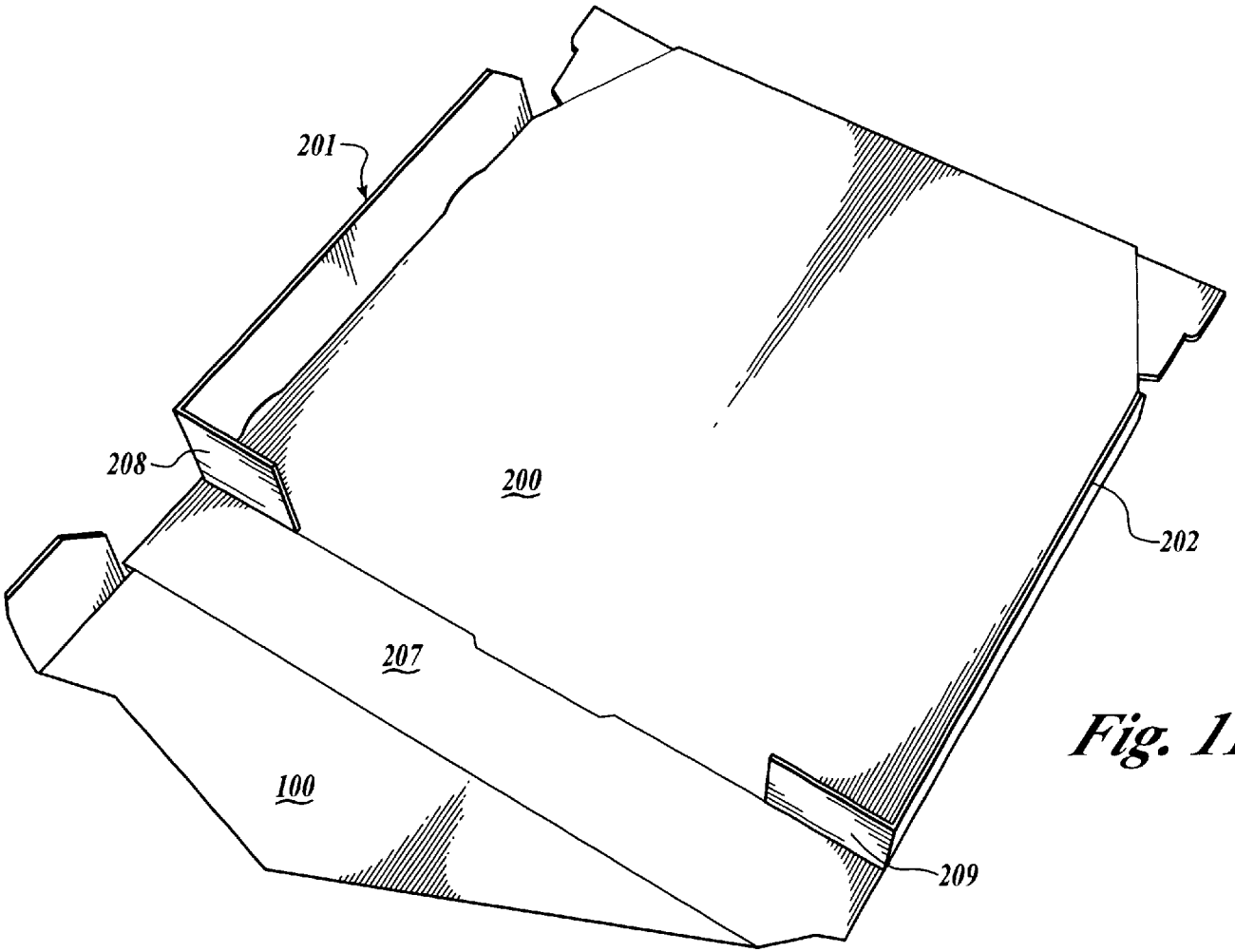
FIG. 11 is a partial perspective view of the top panel assembly.

Sidewall flaps 208 and 209 are substantially rectangular in shape and may be hingedly connected to the top sidewall panels 201 and 202 along hinge lines 208" and 209", respectively, as shown in FIG. 11, or may be connected to rear wall panel 207 along hinge lines 208', 209' as shown in FIGS. 1–10. In the former configuration, sidewall flaps 208 and 209 are adjacent to but are not connected to rear wall panel 207 as depicted in FIG. 11; in the later configuration flaps 208, 209 are adjacent to but not connected to panels 201 and 202, respectively. In the former configuration, sidewall flaps 208 and 209 may be detachably connected to rear wall panel 207 by an incomplete cut line; in the later configuration flaps 208, 209 may be detachably connected to panels 201, 202, respectively by incomplete cut lines. Sidewall flaps 208 and 209 may be clipped at the edge opposite top sidewall panels 201 and 202. Additionally, sidewall flaps 208 and 209 may also have tabs 132 at their outer corners.

In order to further illustrate the various aspects of the invention, FIGS. 3–10 show the blank 20 being erected into the container 30 of the present invention.

The assembly of container 30 is initiated by engaging the corner locking constructions 134, 135. The corner locking constructions 134, 135 are engaged by folding angled sidewall panels 103 and 104 upright and inwardly. This causes sidewall panels 101 and 102 to fold upright and angled sidewall panel bottoms 105 and 106 to fold over bottom panel 100. In a presently preferred embodiment, angled sidewall panel bottoms 105, 106 are sized to permit angled sidewall panels 103 and 104 to form an approximately 45 degree angle with front wall panel 109 when assembled. However, the angled sidewall panel bottoms 105, 106 may be sized to form a greater or lesser angle with the front wall panel 109.

The movement of angled sidewall panel bottoms 105, 106 causes angled front panels 107 and 108 to fold upright. Angled front panels 107 and 108 in turn cause front wall panel 109 to fold upright. Sidewall tabs 115 and 116 are inserted into upright slots 110, 111 locking the angled sidewall panels 103, 104 into an upright position. Sidewall panels 101, 102, angled front panels 107 and 108, and front wall panel 109 are also held into place when assembled by virtue of the hinge connections described above. Front wall panel flap 121 is folded inwardly along hinge line 121' to receive the top panel 200.

Top sidewall flaps 208 and 209 are folded inward and top sidewall panels 201 and 202 are folded upright. Top panel

200 is folded upright relative to rear wall panel 207 about hinge line 200'. Rear wall panel 207 is folded upright relative to bottom panel 100 about hinge line 207'.

When assembled, top 200 overlaps front wall panel flap 121. Top panel flaps 203 and 204 are folded downwardly and then inwardly along hinge lines 203' and 204' respectively, and top panel flap tabs 205 and 206 are engaged in notch regions 117 and 118. Top panel flaps 203 and 204 also overlap outer front wall panel tabs 113 and 114, further holding front wall panel flap 121 and front wall panel 109 in place.

After the container 30 has been assembled and closed as described above, it may be just as easily opened. To open the container 30, an operator pushes inwardly on angled sidewall panels 103 and 104, causing the angled sidewall panels 103, 104 to deform and notch regions 117 and 118 to disengage from top panel flap tabs 205 and 206. Top panel flaps 203 and 204 may then be unfolded downwardly and outwardly, no longer overlapping outer front wall panel tabs 113 and 114.

Angled sidewall panels 103, 104 may include instructional graphics or text inscribed there on. A non-limiting example of instructional text includes "PUSH HERE TO DISENGAGE LOCK". However, it will be appreciated that text or graphics conveying any other message is within the scope of this invention.

Any variety of additional elements may be included, such as, without limitation, vents, specialized liners or grease barriers, etc., without departing from the spirit and scope of the present invention. Similarly, rounding or otherwise trimming the various panels is considered within the scope of the instant invention.

The present invention avoids many of the problems of prior boxes. The present invention is easy to set up and handle, and includes parts, which may be secured together with a minimum effort to provide a practically permanent connection there between. The angled sidewall panels more closely confine and prevent the movement of round or oval products, such as pizza or coiled hose, in the box. The angled sidewall panel tabs and inter-connections between angled sidewalls, sidewalls, angled sidewall bottoms, angled front panels and front wall hold the various walls in a vertical position. The top panel flaps hold the top closed and also hold the outer front wall panel and front wall in place.

While the preferred embodiment of the invention has been illustrated and described, it will be appreciated that various changes can be made therein without departing from the spirit and scope of the invention. In addition, it will be appreciated that the present invention may be used for the transportation and storage of objects other than pizza.

What is claimed is:

1. A box corner locking construction comprising:

a first sidewall panel;

a front wall panel;

an angled sidewall panel, hingedly attached to an end of said first sidewall panel, said angled sidewall panel including a sidewall tab;

an angled sidewall bottom, hingedly attached to said angled sidewall panel; an angled front panel, hingedly attached to said angled sidewall bottom and to said front panel; and an upright slot in said front panel, said upright slot being configured to receive said sidewall tab;

wherein the engagement of the sidewall tab into the upright slot locks the sidewall panel, sidewall bottom and front panel together.

2. The box corner locking construction of claim 1, wherein said angled sidewall panel further comprises a notched region, the notch region being configured to receive a top panel flap.

3. The box corner locking construction of claim 2, wherein each notched region further comprises a recess.

4. The box corner locking construction of claim 1, wherein the angled wall panel forms a predetermined angle relative to said front panel.

5. The box corner locking construction of claim 4, wherein the predetermined angle is about 45 degrees.

6. The box corner locking construction of claim 1, further comprising a front wall panel flap hingedly attached to said front wall panel.

7. The box corner locking construction of claim 6, wherein the front wall panel flap further comprises tabs disposed on an end of said front wall panel flap.

8. The box corner locking construction of claim 1, further comprising a rear wall panel and a top panel hingedly connected to the rear wall panel.

9. The box corner locking construction of claim 8, wherein the top panel further comprises a panel flap arranged to interact with the box corner locking construction and the sidewall tabs to lock the container in a closed state.

10. The box corner locking construction of claim 1, wherein the container is formed from a single piece of material.

11. The box corner locking construction of claim 10, wherein the material is a corrugated board material.

12. A blank for a container comprising:

a single sheet of foldable material cut and scored to define a bottom panel, said bottom panel having a side edge, a front edge and a truncated corner edge extending between said side edge and said front edge, a sidewall panel hingedly attached to said bottom panel along said side edge, said sidewall panel having a front edge, an angled sidewall bottom hingedly attached to said bottom panel along said corner edge, an angled sidewall panel hingedly attached to said angled sidewall bottom and to said front edge of said sidewall panel, said angled sidewall panel having a sidewall tab; and a front panel hingedly attached to said bottom panel along said front edge, said front panel having an upright slot configured to receive said sidewall tab.

13. The blank of claim 12, a rear wall panel attached to said bottom panel.

14. The blank of claim 13 further comprising a top panel hingedly attached to said rear wall panel.

15. The blank of claim 14 further comprising a top panel flap hingedly attached to a front corner of said top panel.

16. The blank of claim 15 further comprising a front wall panel flap hingedly attached to the outer edge of said front wall panel.

17. The blank of claim 15, wherein said angled sidewall panel further comprises a notch region, said notch region being configured to receive said top panel flap.

18. The blank of claim 17, wherein said notch region further comprises a recess.

19. The blank of claim 12, wherein the material is a corrugated board material.

* * * * *